US005640936A

United States Patent [19]

Hudson

[11] Patent Number: 5,640,936

[45] Date of Patent: Jun. 24, 1997

[54] REMOVABLE OIL RESERVOIR FOR DRY SUMP INTERNAL COMBUSTION ENGINES

[75] Inventor: Eric B. Hudson, Hilbert, Wis.

[73] Assignee: Brunswick Corporation, Lake Forest, Ill.

[21] Appl. No.: 418,815

[22] Filed: Apr. 7, 1995

[51] Int. Cl.[6] ..... F01M 11/04

[52] U.S. Cl. ..... 123/196 W; 123/196 A; 184/1.5; 184/6.13

[58] Field of Search ..... 123/196 R, 196 A, 123/196 S, 196 W; 184/6.21, 1.5, 6.13, 105.1

[56] References Cited

U.S. PATENT DOCUMENTS

| | | | |
|---|---|---|---|
| 2,453,217 | 11/1948 | Gregg et al. | 184/6.13 |
| 2,976,864 | 3/1961 | Ford | 123/196 A |
| 3,763,960 | 10/1973 | John | 184/6.13 |
| 3,972,387 | 8/1976 | Braun | 184/105.1 |
| 4,151,823 | 5/1979 | Grosse et al. | 123/196 A |
| 4,724,806 | 2/1988 | Hartwig | 123/196 A |
| 4,903,654 | 2/1990 | Sato et al. | 123/196 W |
| 5,070,831 | 12/1991 | Yunick | 123/196 A |
| 5,085,188 | 2/1992 | Gasparri et al. | 184/1.5 |
| 5,199,914 | 4/1993 | Marsh | 184/1.5 |
| 5,215,164 | 6/1993 | Shibata | 123/196 W |
| 5,454,354 | 10/1995 | Miller | 123/196 A |
| 5,454,960 | 10/1995 | Newsom | 123/196 A |

*Primary Examiner*—Erick R. Solis
*Attorney, Agent, or Firm*—Wood, Phillips, VanSanten, Clark & Mortimer

[57] ABSTRACT

A removable oil tank and oil filter for four cycle dry sump internal combustion engines having particular utility in marine applications. A support for the tank is attached to or near the engine and the oil tank is held in engagement with the support by mechanical quick disconnect retainers. Oil lines connecting the tank and the engine oil circulating system are connected by quick disconnect fluid connectors. One portion of the quick disconnect fluid connectors may be fixedly attached to a support for the tank in a position where they help support the oil tank when the connectors are joined.

4 Claims, 4 Drawing Sheets

REMOVABLE OIL RESERVOIR FOR DRY SUMP INTERNAL COMBUSTION ENGINES

FIELD OF THE INVENTION

The invention is in the field of internal combustion engines and pertains to dry sump oil systems for such engines and, in particular, removable oil storage tanks for such engines.

BACKGROUND OF THE INVENTION

In recent years, interest has increased in the use of four cycle internal combustion engines as power heads for outboard motors and other marine applications. In prior years, two cycle engines were almost universally utilized four outboard motors and some recreational vehicles. In two cycle engines, the lubricating oil is usually mixed with the fuel and lubricates the pistons and bearings as the fuel-oil mixture is inhaled into the engine through the crank case. This oil is eventually burned as part of the fuel mixture.

Four cycle engines normally utilize a lubricating oil distribution system which is separate from the fuel and the fuel does not usually pass through the crank case en route to the cylinders. Oil is usually recirculated many times in the lubrication system of four cycle engines. One of the simplest lubrication systems provides a mechanical means to splash oil onto the moving parts, where it can work into the bearing spaces and fall, by gravity, back into a reservoir to be splashed back onto the moving parts. An improvement upon this system is the addition of a pump which, by means of passages in the engine, delivers oil under pressure directly to bearing surfaces in the engine. Again, oil forced out of said bearing surfaces or flung or drained off of moving parts can fall into a reservoir, below the engine, usually called a sump or oil pan. Systems which use gravity to return engine oil to the reservoir are referred to as "wet sump" systems. In some applications of internal combustion engines, such as motorcycles, acrobatic airplanes and outboard motors, the position in which the engine is used or stored make relying on gravity to return the oil to the reservoir undesirable. In such cases a pump called a scavenge pump removes excess oil from the engine and returns said oil to the reservoir. A second pressure pump is connected to the reservoir removing from it oil to supply the bearings as needed. Engines which utilize an oil reservoir, served by scavenge and pressure pumps, are generally referred to as being of the "dry sump" type.

Although applicable to engines in many types of services, the removable oil tank invention set forth herein is particularly useful to four stroke dry sump outboard motors. While the dry sump engine continually recirculates the oil in the reservoir, it is desirable to change the oil periodically as it becomes contaminated by products of combustion. The location of engines, particularly in marine applications, can make the operation of changing oil a messy proposition. The removable oil tank permits the oil change operation and replacement of its associated oil filter cartridge to take place ashore where the risk of contaminating the environment is lower and the handling of open oil containers can be carried out with better footing. The invention also seeks to make the attachment and removal of the oil tank, form the internal combustion engine application, easy to perform by using quick disconnect fittings. The invention seeks to remedy this problem by providing a removable oil tank and to simplify the mounting of such a tank and its connection to the oil circulation system of the engine.

SUMMARY OF THE INVENTION

The invention is a removable oil storage and supply tank for a dry sump four cycle internal combustion engine having an engine block, piston, crank shaft, crank case, and a lubricating oil system therefor including pump means for circulating oil through the engine. The oil storage and supply tank is separate from the engine and is mounted in a preselected position near the engine or on the engine by mechanical quick disconnect means. A plurality of oil lines connect the tank to the oil system, each oil line comprising a quick disconnect fluid connector, so that the oil lines may be disconnected and the oil tank removed from its mounted position. An oil filter may be attached to a wall of the oil tank, communicating with the interior of the oil tank through passages in the wall.

DETAILED DESCRIPTION OF THE PREFERRED EMBODIMENT

Figure 1:
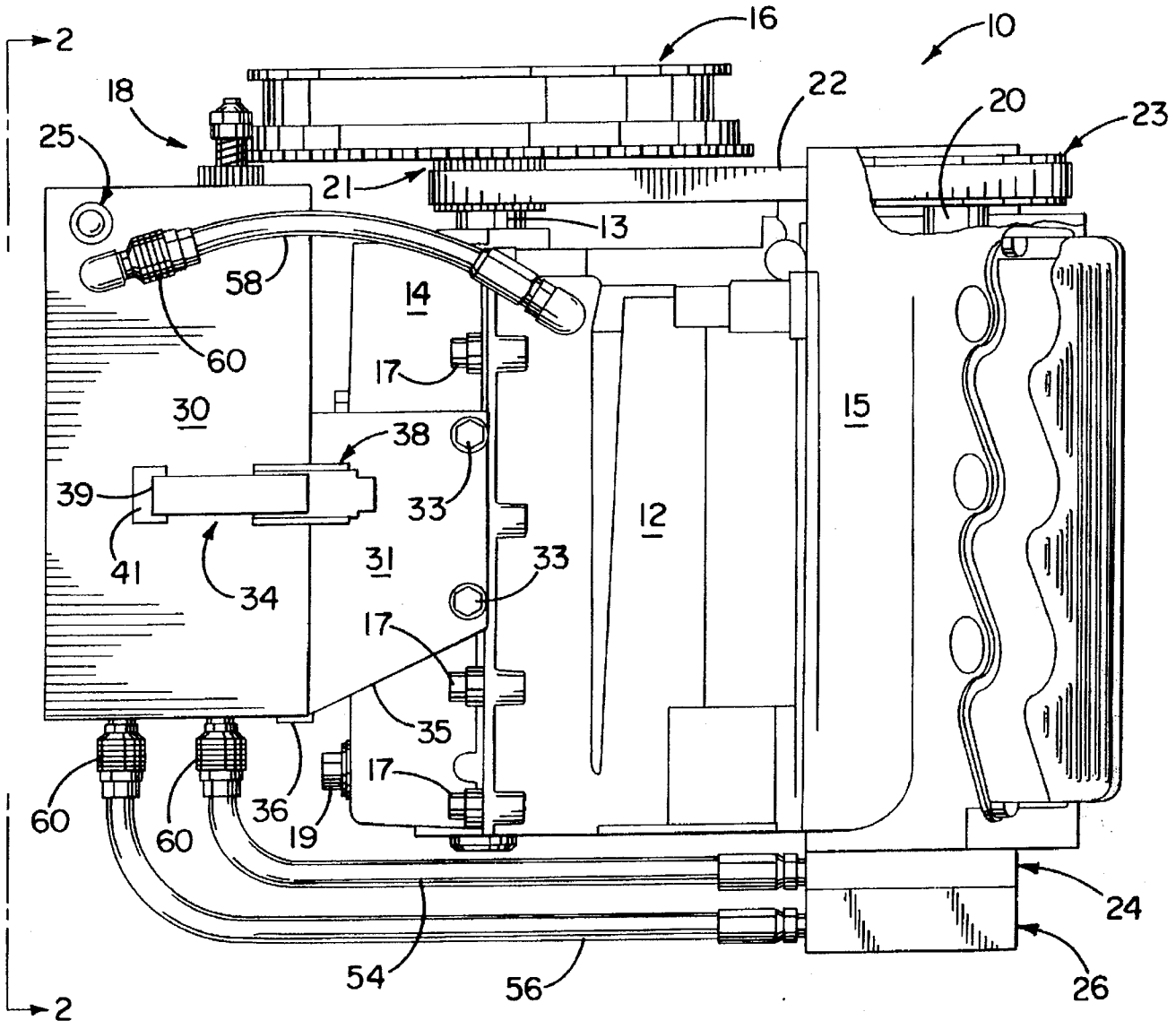
FIG. 1 is a simplified side elevational view of a four cycle engine with a removable oil tank of the invention.
Figure 2:
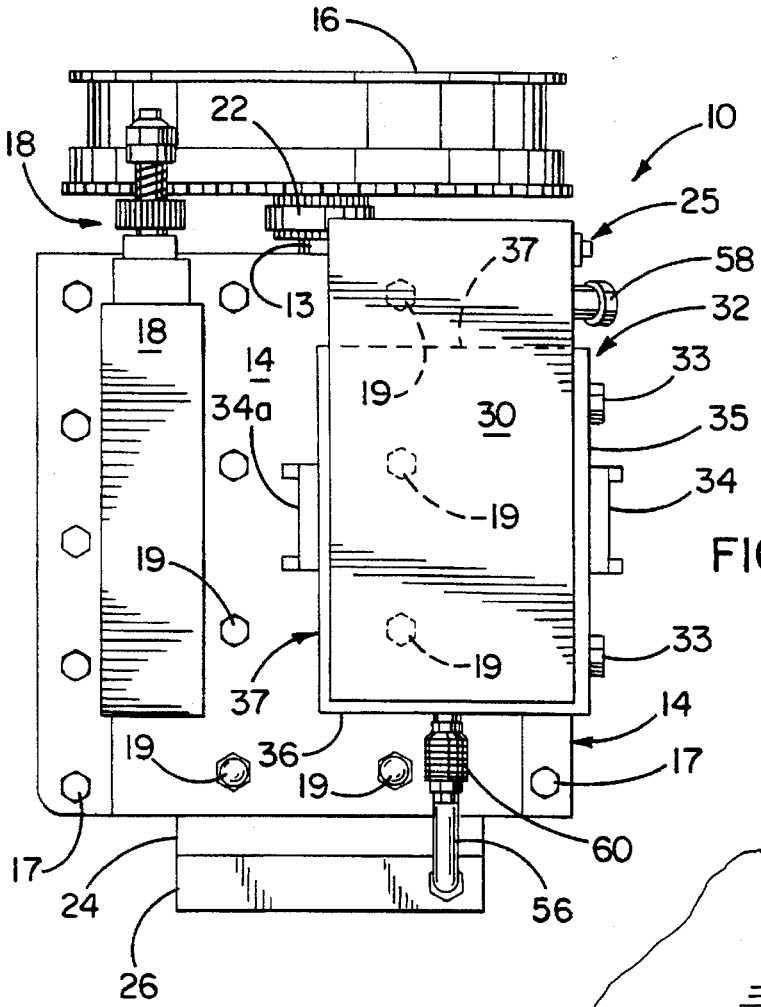
FIG. 2 is a simplified end view of the engine of FIG. 1 taken along line 2—2 of FIG. 1.

Referring to FIGS. 1 and 2, a four cycle overhead cam internal combustion engine 10 is shown with a removable oil tank 30 mounted. In the embodiment here described, the engine is illustrated with the crank shaft 13 axis positioned vertically as it would be if utilized as a power head for an outboard motor. It should be understood that the invention may also be utilized with an engine positioned so that the crank shaft axis is essentially horizontal. The engine 10 is comprised of a motor block 12, including a crank case, which houses the pistons and other elements of the drive mechanism of the engine, a crank shaft 13, a crank case cover 14 and a cylinder head and rocker arm cover 15. Also shown is a cam shaft 20 for overhead valves, a fly wheel 16, a drive belt 22 running between a pulley wheel 21 on the crank shaft 13 and a pulley wheel 23 on the cam shaft 20. A starter 18 is positioned to engage the flywheel 16. An oil pump 24 is provided for pumping oil from the tank 30 and through the lubricating system of the engine 10 and a scavenging oil pump 26 is provided for pumping oil draining into the crank case of the motor block 12 back to the oil tank 30.

In the illustrated embodiment, a generally "L"-shaped bracket 31 supports the tank 30 and is comprised of a side plate 35 extending beside and beyond the crank case cover 14 of the engine 10, a plate 37 extending at 90° to the side plate 35, and a horizontal bottom lip 36 extending under the oil tank 30 as a support.

The bracket 31 is attached to the crank ease cover 14 by bolts 33 which extend through the side plate 35 and are received in threaded bores in bosses (not shown) which may be cast onto the side of the crank ease cover 14. The bolts 33 and the bracket 31 must be strong enough to support the weight of the oil tank 30 and its contents under rigorous operating conditions.

The oil tank 30 is supported at the bottom by the lip 36 upon which the tank 30 rests. The tank 30 is retained in place upon the bracket 31 by a pair of over-center latches 34 which may be of any suitable type known to the art. One such latch 34 has one end 38 hinged to the side plate 35 while the other end 39 engages a detent 41 in the tank 30. With the end 39 of the latch 34 engaged in the detent 41 in the tank 30 and the latch 34 moved to the locked position, the tank will be securely held against the plate 37. A duplicate or similar latch 34*a* is attached to the plate 37 at a point opposite the latch 34 so that it engages the tank 30 in a similar manner as latch 34 but on the opposite side of the tank 30, as illustrated in FIG. 2.

The oil tank has a removable cap 25 through which the oil may be dumped when the tank 30 is removed from the power head 10, and oil added as desired.

Figure 3:
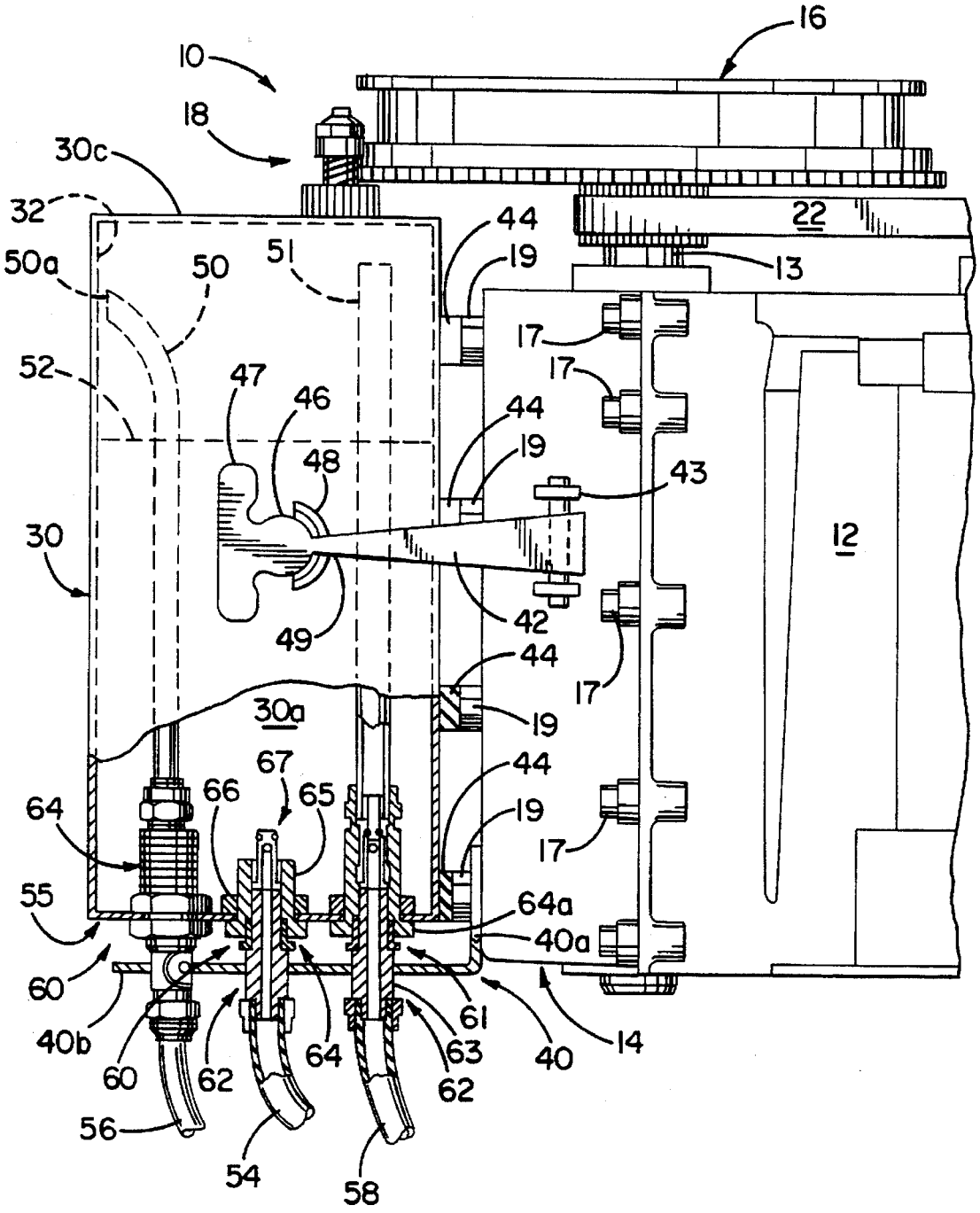
FIG. 3 is a partially cut away and sectioned side view of an alternative removable oil tank of the invention and its associated quick disconnect oil lines.

Three oil lines 54, 56 and 58, are connected so as to communicate with the interior of the oil tank 30: each by a quick disconnect fluid connector 60, described below, which enables each line to be quickly and easily detached from the tank 30 without leakage of oil. As illustrated in FIGS. 1 and 3, the vent line 58 connects the air space above the oil in the oil tank 30 with the interior of the crank case of the motor block 12 to equalize the internal pressure of the two. At the bottom of the tank 30 oil is drawn out through an oil supply line 54 by the action of an engine-driven oil pump 24. The third line is a return line 56 which takes oil from an engine-driven scavenging pump 26 and returns it to the oil tank 30.

Referring now to FIG. 3, an alternate configuration for a removable oil tank 30 is illustrated. In this embodiment the tank 30 is supported at the bottom by the male portion 62 of three quick disconnect connectors 60. The three male portions 62 are fixedly attached to a support bracket 40 by brazing, press fitting or other means known to the art. The support bracket 40 is generally "L"-shaped, having a vertical leg 40*a* and horizontal leg 40*b*. The vertical leg 40*a* is illustrated as attached to the crank case cover 14 by one or more of the bolts 19 which may secure the main crank shaft bearings (not shown) to the crank case cover 14 in a manner known to the art. The bolts 19 pass through receiving bores in the vertical leg 40*a* and clamp the vertical leg 40*a* and the bracket 40 securely to the crank case cover 14. A horizontal leg 40*b* extends outwardly of the crank case cover 14 and beneath the oil tank 30. In this embodiment, all three oil lines 54, 56 and 58 are attached to the tank 30 by quick disconnect fluid connectors 60 which penetrate the bottom of the oil tank 30. The quick disconnect connectors 60 illustrated are manufactured by Parker Brass Products of Division of Parker Fluid Connectors located in Otsego, Mich., sold under the trade name Poly-Tite® and identified by product number 394 PD. Similar fittings made by Aeroquip Corporation of Maumee, Ohio, would also serve the intended purpose well. These connectors 60 are comprised of a male portion 62 having a cylindrical body 63. The cylindrical bodies 63 of the three connectors 60 are rigidly attached to the horizontal leg 40*b* of the bracket 40, for example, by being press fitted into bores through the bracket 40 or being brazed in place.

The quick disconnect connectors 60 also comprise a female portion 64 configured to receive therein the male fitting 62. The female portions 64 of the connectors 60 extend through bores in the bottom 55 of the oil tank 30. The portions 64 have a head 64*a* and a threaded cylindrical body 65 which extends through the bottom 55 of the tank 30 into the interior 30*a* of the tank 30. A nut 66 threads onto the threaded body 65 and traps the bottom 55 of the tank 30 between the head 64*a* and the nut 66; thereby sealingly affixing the female fitting 64 through the bottom of the oil tank 30.

When affixed in the manner described, the male portion 62 of the quick disconnect connectors 60 project rigidly upwardly from the horizontal leg 40*a* of the bracket 40. The oil tank 30 is attached to the bracket 40 by seating the female portions 64 of the connectors 60 firmly onto the male portions 62 so that the two are sealed together. The weight of the tank 30 and its contents serve to maintain this relationship.

The tank 30 is also held firmly against the crank case cover 14 by the action of an elastomeric retaining strap 42 on each side of the tank 30. The straps 42 are attached to the crank ease cover 14 by a hinge 43 or other appropriate means. The straps extend from the hinge 43 along the side of the tank 30 and terminate in a handle 47 and a spherical member 46. An arcuate wall 48 extends outwardly on each side of the tank 30 and is spherical in shape so as to receive and partially surround the spherical member 46. The strap 42 is sized so that it must be placed under considerable tension before the spherical member 46 may be placed within its retainer 48. A channel 49 in the retainer 48 accommodates the stretched body of elastomeric retainer 42. So engaged, the straps 42 securely and elastically retain the oil tank 30 in position atop the support 40 and snugly against the crank case cover 14.

In order to avoid abrasion between the bolts 19 and the tank 30, an elastomeric material 44 should be placed between the two and is preferably attached to the oil tank, for example, by epoxy glue.

Referring further to FIG. 3, a tube 50 is attached to the top of the female member 64 of the connector 60 connected to the oil scavenging line 56. The tube 50 extends the line 56 to a point well above the desired oil level 52 for the tank 30 and is curved toward the back wall 32 of the tank 30 so that the end 50*a* of the tube 50 is positioned adjacent to but apart from the wall 32. The purpose of this positioning is to project returning oil against the wall 32 to foster release of any air that may be entrained therein.

A tube 51 is attached to the top of the female member 64 of the connector 60 connected to the oil vent line 58. This tube 51 extends the vent line 58 into the air space in the tank 30 above the oil level 52 so as to vent the same to the crank case. The oil line 54, through which oil is drawn for lubricating the engine 10, terminates in a quick disconnect fluid connector 60 which includes an oil inlet 67. This inlet 67 is positioned near the bottom of the tank 30 so that oil will be drawn from the tank even if the oil is reduced to a very low level.

Figure 4:
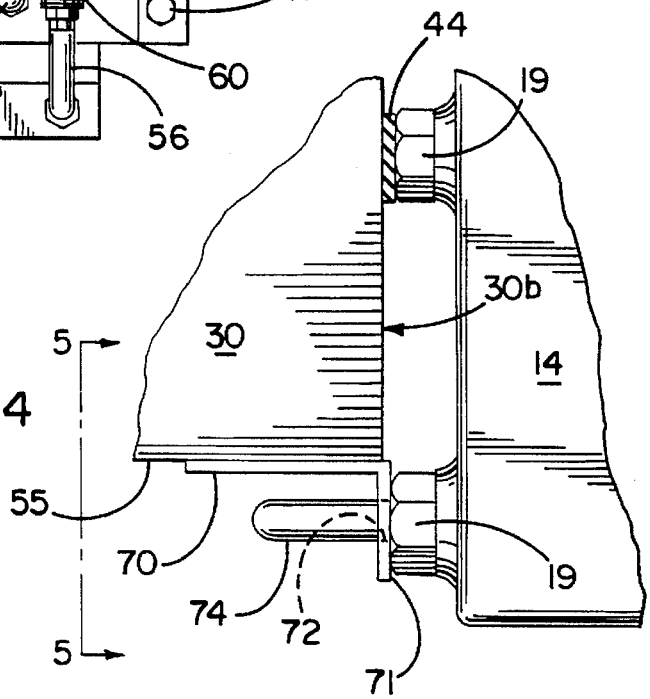
FIG. 4 is an end view of a bottom support for a removable oil tank of the invention.
Figure 5:
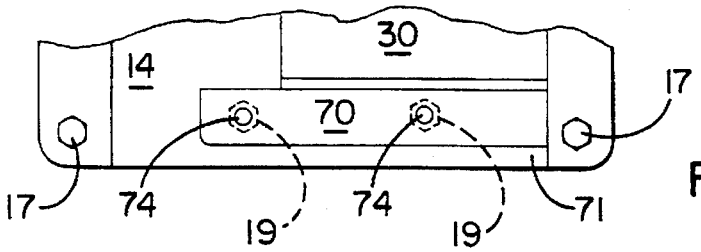
FIG. 5 is a side view of the device of FIG. 4 taken along line 5—5 of FIG. 4.

Referring to FIGS. 4 and 5, an alternative structure for supporting the oil tank 30 upon the crank case cover 14 is illustrated. An elongated "L"-shaped bracket 70 is welded or otherwise affixed to the bottom 55 of the oil tank 30. One leg 71 of the bracket 70 projects downwardly from the oil tank 30 in alignment with the side 30*b* of the oil tank facing the crank case cover 14. Studs 74 project outwardly of one or more of the bolts 19 which hold the crank case cover 14 to the cylinder block 12. Bores 72 through the downwardly projecting leg 71 of the bracket 70 are positioned to receive the studs 74 and thereby position the tank 30 with respect to the crank case cover 14. Alternatively, the studs 74 may emanate from main bearings of the engine 10 and extend through the crank case cover 14 where they are engaged by threaded nuts. This structure replaces the bolts 19. The tank 30 so positioned by the bracket 70 may be retained in position against the crank case cover 14 by elastomeric straps 42 described in connection with FIG. 3 above. Elastomeric pads 44 may be used to cushion the face 30*b* of the oil tank 30 from the bolts 19 or other portions of the crank case cover 14.

Figure 6:
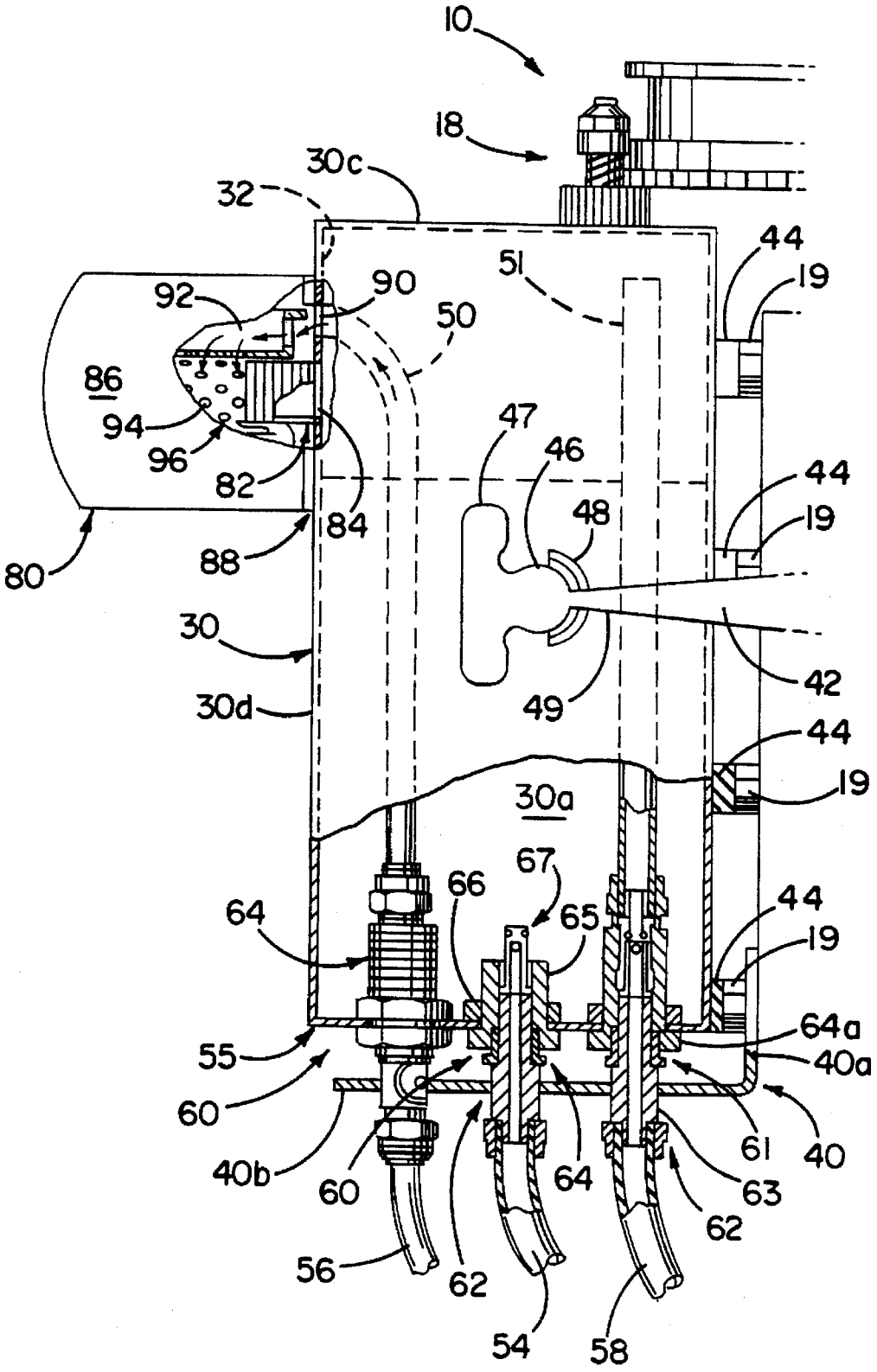
FIG. 6 is a partially cut away side view of an oil filter attached to the oil tank illustrated in FIG. 3.

FIG. 6 illustrates an additional feature of the invention, an oil filter 80 mounted on the front 30*d* of the tank 30. The filter 80 is preferably a screw-on type oil filter such as a FRAM® model PH4967 manufactured by Allied Signal, Inc. of East Providence, R.I. 02916. The filter 80 is attached to the tank 30 by screwing its threaded core 96 onto a threaded nipple 82 which is brazed or otherwise affixed to the wall 30*d* of the tank 30. The wall of the tank 30*d* has a bore 84 therethrough which communicates with the interior of the nipple 82 and provides a path for oil to exit the filter 80 and enter the tank 30.

When screwed onto the nipple 82, the filter core 96 and its attached annular housing 86 are sealed against the wall 30*d* of the tank 30 by the action of an elastomeric ring seal 88 which is pressed between the tank wall 30*d* and the annular filter housing 84.

In the illustrated embodiment, the oil return line 56 and its extension 50 within the tank 30 are further extended through a second bore 90 through the wall 30*d* of the tank 30. The bore 90 is positioned within the periphery of the ring seal 88. Oil returning to the tank 30 through the line extension 50 will enter the filter 80 outside of the threaded nipple 82, proceed through the filter media 92, exit the holes 94 in the core 96 of the filter and return to the tank 30 through the bore 84.

As the filter 80 described typically has a replaceable filter cartridge, it will be recognized that the filter may be changed while the oil tank 30 is either attached to or removed from its mounting.

It will be understood that the invention may be embodied in other specific forms without departing from the spirit or central characteristics thereof. For example, if the engine is disposed horizontally, the bracket 31 shown in FIG. 1 may be re-configured to support the tank 30 alongside of the engine block 12. The bosses which receive the retaining bolts 33 may be relocated to other positions on the engine block, as desired. In any configuration the tank 30 must be mounted so that its top 30*c* is up. While the removable oil tank has been illustrated as mounted upon the engine block 12, those skilled in the art will realize that by use of the flexible oil lines and associated quick disconnect fluid connectors 60 disclosed, the tank 30 may also be mounted on suitable structure adjacent to the engine without departing from the utility of the invention. The present examples and embodiments, therefore, are to be considered in all respects as illustrative and not restrictive, and the invention is not to be limited to the details given herein.

I claim:

1. In an internal combustion engine for watercraft comprising a cylinder block, crank case, crank case cover, piston, crank shaft, crank shaft bearings, an oil tank and a plurality of oil line means for carrying oil between the oil tank and the engine, an improvement comprising:.

a removable oil tank;

means for removably supporting the oil tank adjacent to the engine;

quick disconnect fluid connector means for connecting each of the plurality of oil lines to the oil tank, each quick disconnect means comprising a first element attached to the oil tank at a preselected position and a second element, and means for fixedly supporting the second element of each quick disconnect means at a preselected position relative to the engine to receive thereon the mating first element of each quick disconnect means attached to the tank;

wherein the means for removably supporting the oil tank adjacent to the engine comprises at least one threaded stud projecting from the crank case cover and at least one opening in the oil tank to receive the stud and a nut threaded onto the stud, and wherein the threaded stud projects from a main bearing of the engine and extends through a bore in the crank case cover.

2. In a dry sump internal combustion engine for an outboard motor having an engine block, piston, crank shaft, crank case, an elongate crank case cover oriented generally vertically and having an outer face, a pressurized lubricating oil system having an oil supply pump, an oil scavenging pump, and an oil reservoir, an improvement wherein the oil reservoir may be disconnected and removed from the engine comprising:

an elongate oil tank;

a first oil line interconnecting the oil scavenging pump and the oil tank;

a second oil line interconnecting the oil supply pump and the tank;

a vent line interconnecting the tank and the crank case;

fluid quick disconnect means for interconnecting each of the first and second oil lines and the vent line and the oil tank, wherein each of the quick disconnect means closes upon disconnect so that the oil will not leak from the oil tank when the oil and vent lines are disconnected and the tank is removed from the engine;

means for mounting the tank adjacent to and along the outer face of the crank case cover comprising:

means attached to the crank case cover for providing vertical support for the tank, and latch means attached to one of the tank and the crank case cover and releasably engaging the other for securely retaining the tank adjacent to the outer face of the crank case cover;

wherein the means for providing vertical support for the tank comprises a plurality of pins projecting from the front face of the crank case cover, and the tank comprises means for receiving the pins, whereby the tank is positioned adjacent to the crank case cover for engagement by the latch means;

and wherein the latch means comprises an elongate elastomeric member having one end pivotally attached to the crank case cover and the other comprised of an engaging element, and the means on the tank for receiving and retaining the engaging element, and wherein the receiving means is positioned on the tank such that the elastomeric member must be stretched in order for the engaging element to be received in the receiving means, whereby the tank is held against the crank case cover by tension in the elongate elastomeric member; and pad means interposed between the tank and the crank case cover so as to prevent abrasion of the tank.

3. The improvement of claim 2 wherein the latch means comprises a plurality of elongate over-center opening and closing mechanical latches, means for pivotally attaching one end of the latches to one of the oil tank and the crank case cover, and means on the other of the oil tank and the crank case cover for receiving,engaging, and retaining the other end of the latches when the latches are closed.

4. In a dry sump internal combustion engine having an engine block, piston, crank shaft, crank case, crank case cover, and a lubricating oil system comprising an oil pump and an oil scavenging pump, an improvement comprising an oil reservoir which may be disconnected and removed from the engine comprising:

an oil tank separate from the engine;

a first oil line interconnecting the oil scavenging pump and the oil tank;

a second oil line interconnecting the oil pump and the tank;.

a vent line interconnecting the tank and the crank case;

fluid quick disconnect means for interconnecting each of the first and second oil lines and the vent line and the oil tank, wherein each of the quick disconnect means closes upon disconnect so that the oil will not leak from the oil tank when the oil and vent lines are disconnected and the lank is removed from the engine; and means for supporting the bottom of the tank when attached to the engine comprising a horizontal bracket and means for attaching the bracket to one of the crank case cover and the engine block and wherein quick disconnect means for the first and second oil lines and vent lines comprise female fittings extending through the bottom of the tank, and male fittings extending through the support bracket, so that the oil and vent lines all connect to the bottom of the tank.

* * * * *